United States Patent [19]

Oda et al.

[11] 4,020,261

[45] Apr. 26, 1977

[54] COPY SHEET FOR USE IN PRESSURE SENSITIVE MANIFOLD SHEET

[75] Inventors: Shinichi Oda, Amagasaki; Akira Nakanishi, Sakai; Takio Kuroda, Amagasaki, all of Japan

[73] Assignee: Kanzaki Paper Manufacturing Co., Ltd., Tokyo, Japan

[22] Filed: Mar. 21, 1975

[21] Appl. No.: 560,794

[30] Foreign Application Priority Data

Mar. 26, 1974 Japan ..... 49-34211

[52] U.S. Cl. ..... 428/325; 427/150; 428/336; 428/539

[51] Int. Cl.[2] ..... B41M 5/00

[58] Field of Search ..... 427/150; 428/331, 454, 428/336, 539, 914, 325

[56] References Cited

UNITED STATES PATENTS

| | | | |
|---|---|---|---|
| 2,505,483 | 4/1950 | Green | 427/150 |
| 2,505,484 | 4/1950 | Green | 427/150 |
| 3,466,185 | 9/1969 | Gordon | 427/150 |
| 3,649,357 | 3/1972 | Davis | 427/150 X |
| 3,745,672 | 7/1973 | Duskin | 427/150 X |
| 3,856,551 | 12/1974 | Jenkins | 427/150 X |

*Primary Examiner*—Bernard D. Pianalto
*Attorney, Agent, or Firm*—Armstrong, Nikaido & Marmelstein

[57] ABSTRACT

In a copy sheet for use in a pressure sensitive manifold sheet comprising support having coated thereon a layer of electron accepting reactant material, an improvement which is characterized in that said electron accepting reactant material is a calcined activated clay which is pulverized in water to particle size reduced by at least 10% based on the mean particle size thereof before the pulverization and has a mean particle size of 1 to 10 $\mu$.

9 Claims, No Drawings

COPY SHEET FOR USE IN PRESSURE SENSITIVE MANIFOLD SHEET

This invention relates to copy sheet for use in a pressure sensitive manifold sheet, more particularlly to copy sheet for use in a pressure sensitive manifold sheet which utilizes the electron donor-acceptor colour forming reaction between an electron donating colourless chromogenic material and an electron accepting reactant material.

Various pressure sensitive manifold sheets are known which utilize the electron donor-acceptor colour forming reaction between an electron donating colourless chromogenic material (hereinafter referred to as "colour former") and an electron accepting reactant material (hereinafter referred to as "colour acceptor"). Manifold sheets utilizing the above-mentioned reaction are classified into two general types: those of the transfer-copy system and those of the self-contained system. The transfer-copy system is disclosed, for example, in U.S. Pat. No. 2,730,456, and the self-contained system is disclosed, for example in U.S. Pat. No. 2,730,457. Manifold sheets of the transfer-copy system are further grouped into two types: one comprising a transfer sheet and a copy sheet in combination therewith and the other comprising the combination of these two sheets and one or more middle sheets.

The transfer sheet has a support having coated thereon a layer of a colour former and is prepared by coating one surface of the support with a mixture of binder, microcapsules enclosing a solution or a dispersion of colour former in nonvolatile organic solvent, and water. (The coating of the mixture will hereinafter be referred to briefly as "colour-forming coating".) The copy sheet has a support having coated thereon a layer of a colour acceptor, and is prepared by coating one surface of a support with a mixture of colour acceptor, binder and water. (The resulting coating will hereinafter be referred to briefly as "acceptor coating".) The middle sheet, one surface of which is coated with the colour-forming coating and the other surface with acceptor coating, is obtained by forming the colour-forming coating and acceptor coating on the opposite surfaces of a substract respectively. The manifold sheet of the transfer-copy system is obtained by superposing the transfer sheet on the copy sheet or by interposing one or more middle sheets between these two sheets, with the colour-forming coating facing the acceptor coating.

The manifold sheet of the self-contained system is a single sheet having coated on the same surface with the above-mentioned microcapsules and colour acceptor along with binder.

When a writing or typewriting pressure is applied to manifold sheet of either type, the microcapsules are ruptured, permitting the colour former to contact with the colour acceptor for reaction to form a coloured image.

With such copy sheet and self-contained system sheet, acidic clay or acidic clay activated with an acid is usually used as the colour acceptor. However, use of such colour acceptor requires a large amount of binder to enable the support to support the colour acceptor. The large amount of binder is objectionable to the contact between the colour former and the colour acceptor, causing insufficient colour formation. Moreover, when the surface of acceptor coating is printed, the binder hinders the absorption of printing ink by the acceptor coating, with the resulting disadvantage that the printed surface fails to retain the ink satisfactorily or remains wet with the ink.

Furthermore, acidic or activated clay is not fully effective as a colour acceptor and it is greatly desired to improve its colour forming ability.

An object of this invention is to provide copy sheet for use in pressure sensitive manifold sheet incorporating a novel colour acceptor with which it is possible to reduce the amount of binder to be used and accordingly to ensure an improved colour forming ability.

Another object of this invention is to provide copy sheet for use in pressure sensitive manifold sheet with the use of a colour acceptor having a more excellent colour forming ability than conventional acidic or activated clay.

Thus the ultimate object of this invention is to provide pressure sensitive manifold sheet having an outstanding colour forming ability.

Other advantages and features of this invention will be apparent from the following description.

In preparing copy sheet for use in pressure sensitive manifold sheet, the foregoing objects of this invention can be fulfilled by using, as the colour acceptor, calcined activated clay pulverized in water to particle sizes reduced by least 10% based on the mean particle size thereof before the pulverization, the pulverized clay having a mean particle size of about 1 to 10 $\mu$.

The term "means particle size" used in the specification and appended claims means the median diameter of particles in a mass as determined by the volume distribution of the mass of particles. The median diameter of a mass of particles is a particle size such that the total volume of the particles larger than that particle size is equal to the total volume of the particles smaller than that particle size. For example, with a mass of particles having a mean particle size of 10 $\mu$, the total volume of the particles smaller than 10 $\mu$ is equal to the total volume of the particles larger than 10 $\mu$.

Our researches have revealed that when calcined activated clay which has been subjected to the above pulverization and which has a mean particle size of 1 to 10 $\mu$ is used as a colour acceptor in place of usual acidic clay or activated clay, the following result can be achieved:

(1) The calcined activated clay exhibits a greatly improved colour forming ability as compared with usual acidic or activated clay. (2) The colour acceptor is satisfactorily supportable by the support with a much smaller amount of binder than in the case with conventional acidic or activated clay. (3) Because of the advantages (1) and (2), the manifold paper obtained from the copy sheet of this invention has an outstanding colour forming ability. The present invention has been accomplished based on these novel findings.

The copy sheet of this invention is prepared by forming an acceptor coating on one surface of support. Useful as the supports are various paper and synthetic resin sheets. Examples of synthetic resin sheets are polystyrene sheet, polyethylene sheet, polypropylene sheet and the like. The acceptor coating is formed from a mixture of colour acceptor, binder and water. Examples of binders are casein, gum arabic, gelatin, soybean protein, enzyme protein, starch, oxidized starch, nitrocellulose, carboxymethyl cellulose, hydroxyethyl cellulose and like natural high molecular weight substances, diene polymers such as styrene-butadiene copolymer and methyl methacrylate-butadiene copolymer, acrylic polymers such as acrylate or methacrylate polymers, vinyl polymers such as ethylene-vinyl acetate copolymer, polyvinyl alcohol, styrene-maleic anhydride copolymer, vinyl acetate-maleic anhydride copolymer and like synthetic resins. The colour acceptor is a novel one provided by the present inventors; it is calcined activated clay which has been pulverized in water to particle sizes reduced by at least 10% based on the mean particle size thereof before the pulverization and which has a mean particle size of about 1 to 10 $\mu$.

The calcined activated clay to be subjected to the pulverization for use in this invention is prepared by activating acidic clay with an acid, calcining the activated clay at 100° to 1,000° C and thereafter crushing the calcined product. Preferably, the crushed product is calcined again at 100° to 1,000° C. Acidic clay is activated with acid in a known manner, for example by contacting acidic clay with an acid. Useful acids are sulfuric acid, hydrochloric acid, and like mineral acids as already known. The activated clay is then calcined at 100° to 1,000° C, preferably at 200° to 600° C, usually for about 30 minutes to 10 hours, preferably for 1 to 5 hours, although the calcining time varies with the temperature. If it is calcined at a temperature below 100° C, the clay obtained is poor in activity, whereas temperature above 1,000° C breaks down the crystal structure of clay to result in a poor colour forming ability. The calcined product is then crushed by a dry method. The crushing means is not particularly limited, and various means are employable which include, for example, impact crushers, such as hammer crusher, screen mill, roller crushers such as ring-roll mill and the like. The activated clay is crushed to a mean particle size usually of about 1.2 to 20 $\mu$, preferably of about 2 to 10 $\mu$. According to this invention, it is advantageous to calcine the crushed product at 100° to 1,000° C, preferably at 200 to 600 ° C, for 30 minutes to 10 hours, preferably for 1 to 5 hours. The re-calcining treatment ensures further improved colour forming ability.

According to this invention, the calcined activated clay must be pulverized in water so that the resulting product has particle sizes which have been reduced by at least 10% based on the mean particle size of the clay before the pulverization. The pulverized clay must have a mean particle size of 1 to 10 $\mu$. The clay to be used in this invention must fulfil these two essential requirements. An outstanding colour forming effect is not achievable with calcined activated clay which has not been subjected to the above pulverization although it may have a means particle size of 1 to 10 $\mu$ or with one whose mean particle size is not in the range of from 1 to 10 $\mu$ after the pulverization. It is critical that the pulverization be conducted in water so as to reduce the mean particle size of clay before pulverization by at least 10%, preferably by at least 15%. If the reduction is less than 10%, an outstanding improvement is not attainable in the colour forming ability. Furthermore, unless the pulverization is conducted in water, there arises the objection that an outstanding improvement is not attainable in the colour forming ability.

According to this invention, it is also essential that the calcined activated clay have a mean particle size of 1 to 10 $\mu$, preferably of 2 to 8 $\mu$. With the mean particle size less than 1 $\mu$, the acceptor coating composition prepared has a greatly increased viscosity and the resulting acceptor coating exhibits markedly reduced picking resistance when subjected to printing. Conversely, if the mean particle size is larger than 10 $\mu$, it is impossible to obtain a compact and uniform acceptor coating, with the result that the acceptor coating formed almost fails to give a coloured image of uniform and high density. Moreover, the acceptor coating composition formulated is low in fluidity.

The pulverization is conducted by using a sand grinder, attritor, colloid mill or like device, among which sand grinder is especially preferable. These devices of the conventional types are useful. The sand grinder, for example, has a container and finely devided hard particles placed therein, in which a aqueous material to be treated can be passed through these particles by stirring these particles. Particles to be used are those of hard glass, hard plastic resin, metal and like hard material, among which those having a diameter of less than 3 mm are preferable.

The ratio of calcined activated clay to water is usually 1/9 to 6/4, preferably 2/8 to 4/6. Preferably, the mixture is subjected to the pulverization with its pH adjusted to at least 7.0, preferably to about 8.0 to 11.0. This enhances the activity of the calcined activated clay as well as the stability of the coating composition containing a colour acceptor. Useful pH adjusting agents include, for example, sodium hydroxide, potassium hydroxide and like caustic alkalis, sodium silicate and like alkali silicate, sodium carbonate, potassium carbonate and like alkali carbonate, ammonia, etc.

The mixture of calcined activated clay and water to be subjected to the pulverization may contain, when desired, at least one of polyvalent metal oxides, hydroxides and carbonates, kaolin, calcined kaolin, attapulgite, zeolite, bentonite and like clays, silicic acid, aluminum silicate, zinc silicate, barium sulfate, etc. Examples of polyvalent metals are aluminum, titanium, calcium, magnesium, barium, zinc, etc. These additives are used in an amount of usually 1 to 100 wt.%, preferably about 5 to 50 wt.%, based on the calcined activated clay. Among the additives enumerated above, polyvalent metal oxides, hydroxides and carbonates are especially preferable because they add to the active properties of the calcined activated clay.

The calcined activated clay is subjected to the pulverization in water, in the form of a paste or dispersion. At this time a known dispersing agent or dispersion stabilizer is usable, examples thereof being sodium polyacrylate, sodium alginate, sodium polyphosphate, carboxymethyl cellulose, ammonium salt of styrene-maleic anhydride copolymer, sodium alkylbenzenesulfonate, etc.

To prepare an acceptor coating composition according to this invention, the calcined activated clay subjected to the pulverization and containing the water added thereto for the pulverization is uniformly mixed with a binder, with further addition of water when so desired. The composition is formulated in such manner that the paste or dispersion of calcined activated clay resulting from the pulverization is mixed with a binder, with addition of the above-mentioned additive when so desired. Alternatively, the paste or dispersion is concentrated into a cake by suitable concentrating means such for example as a filter press, centrifugal separator or vacuum concentrator, and the cake is thereafter dispersed again in water along with a binder.

The proportions of calcined activated clay subjected to the pulverization, binder and water to be mixed together, which are widely variable depending on the kinds of the calcined activated clay and binder used, are usually about 5 to 65 wt.%, preferably about 10 to 60 wt.%, of calcined activated clay, about 1.5 to 30 wt.%, preferably 2 to 25 wt.%, of binder and about 30 to 90 wt.%, preferably 40 to 85 wt.% of water. The acceptor coating composition is applied to one surface of support in an amount of 2 to 20 g/m², preferably 4 to 13 g/m², calculated as solids.

According to the invention, conventional transfer sheets are usable which are prepared by forming a colour-forming coating on a support. Useful support are the same as in the copy sheet. The colour-forming coating is formed from a conventional coating composition which is a mixture of microcapsules enclosing a solution or a dispersion of colour former in nonvolatile organic solvent, binder and water. Useful colour formers are for example, lactone dyes such as crystal violet lactone, malachite green lactone, rhodamine lactone, methylene blue dyes such as benzoyl leucomethylene blue, fluoran derivatives such as 3-diethylamino-7-benzylaminofluoran, 3-diethylamino-7-aminofluoran, 3,7-bisdiethylaminofluoran, spiropyran compounds such as benzo-β-naphthospiropyran, 6′-nitro-1,3,3-trimethylspiropyran and leuco auramine compounds such as 1-[bis-(p-dimethylaminophenyl)-methyl]-pyrolidine, 1-[bis-(p-dimethylaminophenyl)-methyl]-piperidine, and the like. Usable as the nonvolatile organic solvent to be encapsulated along with the colour former are, for example, alkylnapthalene, alkylbiphenyl, triallyldimethane, kerosene, etc. Examples of encapsulating agents are gelatin, gum arabic, carboxymethyl cellulose, polyvinylalcohol and like high molecular weight substances. Useful binders are the same as those usable for copy sheet. In this invention other additives such as starch powder, pulp powder, antifoaming agent may be added to the coating composition.

The proportions of microcapsules enclosing the colour former, binder and water to be mixed together, which are widely variable depending on the kinds of microcapsules enclosing the colour former and binder used, are usually about 5 to 40 wt.%, preferably about 8 to 25 wt.%, of microcapsules enclosing the colour former, about 3 to 40 wt.%, preferably about 5 to 20 wt.%, of binder and about 40 to 90 wt.%, preferably 55 to 88 wt.%, of water. The mixture, namely the colour-forming coating composition is applied to one surface of support in an amount of about 2 to 15 g/m², preferably about 3 to 10 g/m², calculated as solids.

To prepare a transfer sheet or copy sheet according to this invention, the colour-forming coating composition or acceptor coating composition is applied onto a support by any of various suitable means including air knife coater, roll coater, blade coater, bar coater and etc.

According to this invention, a middle sheet is prepared by applying the colour-forming coating composition and acceptor coating composition to the opposite surfaces of support respectively.

The pressure sensitive manifold sheet of the self-contained system of the present invention is usually prepared by the following two methods. One of them is the method in which one surface of support is coated with a mixture of microcapsules enclosing the colour former, colour acceptor, binder and water. The other method is conducted by coating the colour-forming coating composition onto one surface of support and then further coating the acceptor coating composition onto the resulting coating of the colour-forming coating composition. In these methods the same microcapsules, colour acceptor, binder, colour-forming coating composition and acceptor coating composition as mentioned before are usable. The ratio of the microcapsules to the colour acceptor in the coating is 2 : 7–5 : 2 by weight preferably about 2 : 4–5 : 4 by weight.

This invention will be described below in greater detail with reference to examples, which are given for illustrative purposes only and are not limitative in any way. Throughout examples and comparision examples, the parts and percentages are all by weight unless otherwise specified.

The copy sheets obtained in examples and comparison examples are evaluated in the following manner.

(1). Determination of Colour Forming Ability

In 100 parts of alkylnaphthalene are dissolved 3 parts of Crystal Violet lactone and 1 part of benzoyl leuco Methylene Blue. The oily solution obtained is added to 316 parts of 6& aqueous solution of gelatin to prepare an emulsion containing suspended particles having a mean particle size of 4.8 μ. To the emulsion are added 190 parts of 10% aqueous solution of gum arabic and 106 parts of water, and the mixture is adjusted to a pH of 4.2 with acetic acid.

Subsequently, the resulting system is cooled to 10° C, and 13 parts of 10% formalin solution. The mixture is adjusted to a pH of 10.2 with 5% aqueous solution of sodium hydroxide and stirred for 10 hours. Fifty parts of 20% aqueous solution of oxidized starch and 15 parts of cellulose powder are thereafter added to the mixture to obtain a microcapsule-containing coating composition, which is applied to a paper substrate weighing 40 g/m² in an amount of 5 g/m² by dry weight. In this way transfer sheets are prepared.

The transfer sheet is superposed on the copy sheet obtained in each of Examples and Comparison Examples other than Example 25 and Comparison Example 20, with the coatings facing each other. In the case of Example 25 and Comparison Example 20, a plurality of the same sheets are placed one over the other. Each set of the sheets is subjected to an impact pressure of about 1 kg/cm² by a pressure applicator of the impact type for colour formation. The density of the colour formed is measured 10 seconds and 30 minutes thereafter my Macbeth desitometor, Model No. RD-100R (manufactured by Macbeth Corporation, U.S.A.) in the light wavelength range of 400 to 500 mμ.

2. Determination of Printability a. Transferability and absorption of printing ink The coating surface of the copy sheet obtained in each of Examples and Comparison Examples is printed with a black colour printing ink (trade mark "New Champion G Ink", product of Dai Nippon Ink Kagaku Kogyo Co., Ltd., Japan) by RI printability tester (manufactured by Akira Industry Co., Japan). The density of the print is measured by Macbeth densitometor, Model No. RD-100R.

b. Picking resistance

The coating surface of the copy sheet obtained in each of Examples and Comparison Examples is printed with a high tack printing ink (trade mark "Printing Ink Red B", product of Toka Shikiso Chemical Mfg. Co., Ltd., Japan) by RI printability tester. The degree to which the coating is peeled from the substrate is determined with the unaided eye in accordance with the following criteria:

A: Excellent
B: Good
C: Poor
D: Very poor

3. Determination of Mean Particle Size

Measured by Coulter counter, Model TA (manufactured by Coulter Electronics Inc., U.S.A.).

EXAMPLES 1 TO 4 AND COMPARISON EXAMPLES 1 TO 12

Preparation of Calcined Activated Clay

Acidic clay is treated with 32% sulfuric acid at 85° C for 6 hours, and the treated clay is washed with water until sulfonic acid group is removed. The product is subjected to calcining treatment under the following four kinds of conditions to obtain four kinds of calcined activated clay.

A. Treatment with hot air at 150° C for 1 hour.
B. Treatment with hot air at 350° C for 3 hours.
C. Treatment with hot air at 150° C for 1 hour and subsequent crushing treatment, followed by treatment with hot air at 150° C for 3 hours.
D. Treatment with hot air at 150° C for 1 hour and subsequent crushing treatment, followed by treatment with hot air at 350° C for 3 hours.

Activation by Pulverization

To 150 parts of water is dissolved 0.4 part of sodium polyphosphate, and 100 parts of each of the 4 kinds of calcined activated clay (A), (B), (C) and (D) is added to the solution to obtain 4 kinds of mixtures. For Comparison Examples, 100 parts of acidic clay, kaolin, attapulgite and talc are used respectively. The mixtures are treated in a propeller mixer (Model SC-VS, manufactured by MATSUSHITA ELECTRIC IND. Co., Ltd., Japan; 3,000 r.p.m.) for 20 minutes to obtain dispersions.

The dispersions are then treated for 15 minutes by sand grinder (Model 1/8G, manufactured by Igarashi Kikai Seizo Co., Ltd., Japan; six ⅛-gallon cylinder type; amount of sand, 150 cc; mean grain size of sand, 1 mm; 1,000 r.p.m.)

Preparation of Acceptor Coating Composition

To each of the dispersions obtained above are added 50 parts of 2% aqueous solution of carboxymethyl cellulose and 36 parts of carboxylated styrene-butadiene copolymer latex (styrene : butadiene = 60: 40) having a concentration of 50%, and the resulting mixture is treated for 10 minutes by propeller mixer (Model SC-VS) to prepare a acceptor coating composition.

For comparison, acceptor coating compositions are prepared which have not been subjected to pulverization.

Preparation of Copy Sheet

Each of the acceptor coating compositions formulated as above is applied, in an amount of 5.5 g/m² calculated as solids, to a paper weighing 40 g/m² by a wire wounded coating rod, dried and then calendered to obtain a copy sheet shown in Table 1.

Evaluation of Copy Sheet

The copy sheets are evaluated according to the methods described above, with the results given in Table 2.

Table 1

| | Kind of colour acceptor | Pulverization | Colour acceptor coating composition concentration (%) | pH | Mean particle size of colour acceptor (μ) | Reduction*3 of pulverized colour acceptor (%) |
|---|---|---|---|---|---|---|
| Ex. 1 | Activated calcined clay (A) | *1 ○ | 35 | 4.1 | 6.4 | 11.1 |
| Comparison Ex. 1 | " | X*2 | 20 | 4.2 | 7.2 | — |
| Ex. 2 | Activated calcined clay (B) | ○ | 35 | 4.1 | 6.2 | 16.2 |
| Comparison Ex. 2 | " | X | 20 | 4.1 | 7.4 | — |
| Ex. 3 | Activated clacined clay (C) | ○ | 35 | 4.2 | 5.5 | 19.1 |
| Comparison Ex. 3 | " | X | 20 | 4.2 | 6.8 | — |
| Ex. 4 | Activated clacined clay (D) | ○ | 35 | 4.2 | 5.9 | 19.2 |
| Comparison Ex. 4 | " | X | 20 | 4.2 | 7.3 | — |
| Comparison Ex. 5 | Acidic clay | ○ | 35 | 6.4 | 5.6 | 20.0 |
| Comparison Ex. 6 | " | X | 20 | 6.4 | 7.0 | — |
| Comparison Ex. 7 | Kaolin | ○ | 35 | 6.9 | 2.9 | 6.4 |
| Comparison Ex. 8 | " | X | 20 | 6.8 | 3.1 | — |
| Comparison Ex. 9 | Attapulgite | ○ | 35 | 9.4 | 7.5 | 8.5 |
| Comparison Ex. 10 | " | X | 20 | 9.3 | 8.2 | — |
| Comparison Ex. 11 | Talc | ○ | 35 | 8.6 | 8.3 | 17.0 |
| Comparison Ex. 12 | " | X | 20 | 8.5 | 10.0 | — |

Note:
*1Pulverization is conducted.
*2Pulverization is not conducted.
*3Reduction of mean particle size of pulverized colour acceptor Table 2

| | Density of the colour | | Printability | |
|---|---|---|---|---|
| | 10 seconds after | 30 minutes after | density of print | picking resistance |
| Ex. 1 | 0.46 | 0.50 | 1.13 | A |
| Comparison Ex. 1 | 0.40 | 0.44 | 0.89 | C |
| Ex. 2 | 0.50 | 0.54 | 1.15 | A |
| Comparison Ex. 2 | 0.43 | 0.45 | 0.90 | C |
| Ex. 3 | 0.51 | 0.54 | 1.16 | A |
| Comparison Ex. 3 | 0.43 | 0.45 | 0.92 | C |
| Ex. 4 | 0.52 | 0.55 | 1.18 | A |
| Comparison Ex. 4 | 0.44 | 0.46 | 0.92 | C |
| Comparison Ex. 5 | 0.36 | 0.40 | 1.00 | B |
| Comparison Ex. 6 | 0.31 | 0.35 | 0.89 | C |
| Comparison | | | | |

Table 2-continued

| | Density of the colour | | Printability | |
|---|---|---|---|---|
| | 10 seconds after | 30 minutes after | density of print | picking resistance |
| Ex. 7 | 0.21 | 0.22 | 1.21 | A |
| Comparison Ex. 8 | 0.20 | 0.21 | 1.16 | A |
| Comparison Ex. 9 | 0.41 | 0.44 | 0.95 | B |
| Comparison Ex. 10 | 0.37 | 0.41 | 0.89 | C |
| Comparison Ex. 11 | 0.18 | 0.18 | 0.93 | C |
| Comparison Ex. 12 | 0.17 | 0.18 | 0.88 | D |

Table 2 reveals that the copy sheet obtained in each of Examples has very excellent colour forming ability and printability, whereas the copy sheets obtained in Comparison Examples are inferior in colour forming ability as well as in printability, even with the mechanical activation treatment.

EXAMPLES 5 TO 11 AND COMPARISON EXAMPLES 13 TO 17

Preparation of Calcined Activated Clay

Acidic clay is treated with 32% sulfuric acid at 85° C for 6 hours, and the treated clay is washed with water until sulfonic acid group is removed. The product is then treated with hot air at 200° C for 1 hour, crushed and then treated with hot air again at 400° C for 2 hours. The calcined activated clay is screened to obtain 5 kinds of clay different in mean particle size.

Activation by Pulverization

To 150 parts of water is dissolved 0.4 part of sodium polyphosphate, and 100 parts of each of the 5 kinds of calcined activated clay is added to the solution to obtain 5 kinds of mixtures, which are treated for 20 minutes in a propeller mixer (Model SC-VS) to obtain dispersions.

As shown in Table 2, the dispersions are then treated by sand grinder (Model 1/8G, manufactured by Igarashi Kikai Seizo Co., Ltd., Japan) and attritor (Model MA-ISC, manufactured by MItsui-Miike Seisakusho, Japan, 5 liter capacity).

For comparison, dispersions are prepared as listed in Table 2 by propeller mixer (Model SC-VS) and Kady mill (Model 140-25, manufactured by Nagase Tekkosho, Japan, 150 liter capacity).

Acceptor coating compositions and copy sheets are prepared in the same manner as in Example 1. The copy sheets are evaluated with the results given in Tables 3 and 4.

Table 3

| | Mean [1] particle size of colour acceptor (μ) | Means of pulverization | Time for pulverization (min.) | Colour acceptor [2] coating composition | | Mean particle size of colour acceptor (μ) | Reduction of [3] pulverized colour acceptor (%) |
|---|---|---|---|---|---|---|---|
| | | | | concentration (%) | pH | | |
| Comparison Ex. 13 | 12.3 | Attritor | 20 | 35 | 4.2 | 11.0 | 10.6 |
| Ex. 5 | 12.3 | Sand grinder | 25 | 35 | 4.2 | 7.4 | 39.8 |
| Ex. 6 | 10.2 | " | 14 | 35 | 4.2 | 8.1 | 20.5 |
| Comparison Ex. 14 | 7.8 | — | — | 20 | 4.2 | 7.8 | 0 |
| Ex. 7 | 7.8 | Sand grinder | 13 | 35 | 4.2 | 6.5 | 16.7 |
| Ex. 8 | 7.8 | " | 35 | 35 | 4.2 | 3.9 | 50 |
| Ex. 9 | 7.8 | Attritor | 40 | 35 | 4.2 | 7.0 | 10.3 |
| Comparison Ex. 15 | 3.3 | Sand-grinder | 10 | 33 | 4.2 | 3.0 | 8.0 |
| Ex. 10 | 3.3 | Sand grinder | 20 | 33 | 4.2 | 2.8 | 15.2 |
| Ex. 11 | 2.3 | " | 85 | 25 | 4.2 | 1.7 | 26.1 |
| Comparison Ex. 16 | 7.8 | Propeller mixer | 130 | 20 | 4.2 | 7.8 | 0 |
| Comparison Ex. 17 | 7.8 | Kady mill | 130 | 22 | 4.2 | 7.6 | 2.6 |

[1] before pulverization
[2] after pulverization
[3] reduction of mean particle size of pulverized colour acceptor Table 4

| | Density of the colour | | Printability | |
|---|---|---|---|---|
| | 10 seconds after | 30 minutes after | density of print | picking resistance |
| Comparison Ex. 13 | 0.40 | 0.43 | 0.89 | D |
| Ex. 5 | 0.48 | 0.52 | 1.06 | B |
| Ex. 6 | 0.47 | 0.51 | 0.95 | B |
| Comparison Ex. 14 | 0.41 | 0.45 | 0.95 | C |
| Ex. 7 | 0.50 | 0.53 | 1.15 | A |
| Ex. 8 | 0.51 | 0.55 | 1.18 | A |
| Ex. 9 | 0.46 | 0.49 | 1.01 | B |
| Comparison Ex. 15 | 0.42 | 0.45 | 0.96 | C |
| Ex. 10 | 0.52 | 0.56 | 1.18 | B |
| Ex. 11 | 0.53 | 0.56 | 1.19 | B |
| Comparison Ex. 16 | 0.41 | 0.45 | 0.95 | C |
| Comparison Ex. 17 | 0.41 | 0.45 | 0.90 | C |

Table 4 indicates that the copy sheets obtained in Examples 5 to 10 have very excellent colour forming ability and printability. Although the copy sheet of Example 11 gives a very high colour density, the coating composition tends to be viscous, so that water is added for dilution to lower the concentration of the coating composition. The picking resistance of the copy sheet, although acceptable, is slightly low.

In Comparison Example 13, the colour acceptor is prone to precipitation in the coating composition, and the copy sheet obtained gives uneven colour density and exhibits poor printability. With Comparison Example 15, the reduction in mean particle size is 8.0% and the results achieved are not satisfactory. In the case of Comparison Examples 16 and 17, the pulverization, athough conducted for a long period of time, can not effectively reduce the mean particle size of the reactant material as desired. Satisfactory results are not available therefore.

EXAMPLES 12 TO 20 AND COMPARISON EXAMPLE 18

Activation by Pulverization

The same calcined activated clay as used in Example 1, various metal compounds and clays are mixed together by propeller mixer (Model SC-VS) for 20 minutes in the proportions listed in Table 5 to prepare 10 kinds of dispersions.

The dispersions are subjected to activation treatment by sand grinder under the same conditions as in Example 1 for 20 minutes.

Preparation of Colour Acceptor

To each of the dispersions obtained above are added 10 parts of 10% aqueous solution of oxidized starch and 36 parts of carboxylated styrene-butadiene copolymer latex (styrene : butadiene = 60 : 40) having a concentration of 50%, and the mixture is treated by propeller mixer (Model SC-VS) for 10 minutes to obtain an acceptor coating composition.

In the same manner as in Example 1, a copy sheet is prepared, which is evaluated with the results shown in Table 6.

Table 5

| | Dispersion before pulverization | | | | | | | Colour acceptor coating composition | |
|---|---|---|---|---|---|---|---|---|---|
| | Activated calcined clay | Metal compound or clay | | Dispersing agent | | concentration | | concentration | |
| | parts | kind | parts | kind | parts | (%) | pH | (%) | pH[3] |
| Ex. 12[2] | 100 | — | — | sodium hexamethaphosphate | 0.5 | 39 | 9.6 | 35 | 9.4 |
| Ex. 13 | 90 | ZnO | 10 | sodium polyphosphate | 1.0 | 39 | 7.0 | 35 | 7.0 |
| Ex. 14 | 90 | " | 10 | " | 0.4 | 33 | 7.0 | 30 | 8.7 |
| Ex. 15[2] | 80 | " | 20 | sodium polyacrylate | 1.0 | 33 | 8.9 | 30 | 8.8 |
| Ex. 16 | 80 | $CaCO_3$ | 20 | " | 1.0 | 33 | 7.8 | 30 | 7.8 |
| Ex. 17 | 80 | $Al(OH)_3$ | 20 | " | 1.0 | 33 | 7.5 | 30 | 7.5 |
| Ex. 18[2] | 60 | ZnO | 40 | " | 1.0 | 35 | 9.8 | 30 | 9.7 |
| Ex. 19[2] | 65 | Calcined[1] talc | 35 | sodium polyoligostyrene sulfonate | 0.9 | 36 | 8.5 | 30 | 8.5 |
| Ex. 20[2] | 60 | Calcined[1] kaolin | 40 | sodium polyphosphate | 0.8 | 30 | 9.5 | 30 | 9.4 |
| Comparison Ex. 18 | 45 | " | 55 | " | 0.8 | 30 | 6.0 | 30 | 6.0 |

Note:
[1]Calcined talc and kaolin are prepared by calcining at 900° C for 3 hours.
[2]Dispersion before pulverization of Example 12 is adjusted to pH 9.6 by adding ammonium hydroxide, and those of Examples 15, 18, 19 and 20 are adjusted by sodium hydroxide.
[3]Colour acceptor coating composition of Example 14 is adjusted to pH 8.7 by adding sodium hydroxide, and that of Example 19 is adjusted by ammonium hydroxide.

Table 6

| | Density of the colour | | Printability | |
|---|---|---|---|---|
| | 10 seconds after | 30 minutes after | density of print | picking resistance |
| Ex. 12 | 0.52 | 0.55 | 1.11 | B |

Table 6-continued

| | Density of the colour | | Printability | |
|---|---|---|---|---|
| | 10 seconds after | 30 minutes after | density of print | picking resistance |
| Ex. 13 | 0.60 | 0.69 | 1.12 | B |
| Ex. 14 | 0.62 | 0.73 | 1.14 | A |
| Ex. 15 | 0.62 | 0.74 | 1.15 | A |
| Ex. 16 | 0.60 | 0.68 | 1.21 | B |
| Ex. 17 | 0.55 | 0.63 | 1.13 | B |
| Ex. 18 | 0.62 | 0.73 | 1.16 | A |
| Ex. 19 | 0.47 | 0.52 | 1.12 | B |
| Ex. 20 | 0.51 | 0.62 | 1.20 | B |
| Comparison Ex. 18 | 0.45 | 0.48 | 1.18 | C |

Table 6 indicates that each of Examples gives a copy sheet having excellent colour forming ability and printability. Especially those obtained in Examples 13 to 18 are relatively superior in colour density and printability.

Comparison Example 18 wherein an excess amount of calcined kaolin is used fails to attain the desired results.

EXAMPLES 21 TO 24 AND COMPARISON EXAMPLE 19

Preparation of Calcined Activated Clay

Acidic clay is treated with 34% sulfuric acid at 90° C for 6 hours, and the treated clay is washed with water until sulfonic acid group is removed. The product is then treated with hot air at 180° C for 1 hour, crushed and then treated with hot air again at 250° C for 3 hours.

Activation by Pulverization

To 200 parts of water is dissolved 5 parts of 20% aqueous solution of sodium polyacrylate, and 80 parts of calcined activated clay prepared above and 20 parts of zinc oxide are added to the solution. The mixture is made into a dispersion of pH 7.0 by propeller mixer (Model 575-DOS-40, manufactured by Satake Chemical Equipment Mfg. Ltd., Japan, 40 HP, 1160 r.p.m.) for 20 minutes. The pH of the same dispersions as above is adjusted to 8.0, 9.1 and 10.5 respectively. Each of the dispersions is subsequently treated by continuous-type sand grinder (Model 32G, manufactured by Igarashi Kikai Seizo Co., Ltd., Japan; amount of sand, 85 kg; mean grain size of sand, 1.5 mm; 900 r.p.m.).

Preparation of Acceptor Coating Composition

To each of the dispersions are added 10 parts of 10% aqueous solution of oxidized starch serving a stabilizer and binder and 38 parts of carboxylated methyl methacrylate-butadiene copolymer latex (methyl methacrylate : butadiene =66 : 34) having a concentration of 47%, and the mixture is made into an acceptor coating composition by propeller mixer (Model 575-DOS-40) for 10 minutes.

Preparation of Copy Sheet

The acceptor coating composition obtained is applied, in an amount of 7 g/m² calculated as solids, to a paper substrate weighing 40 g/m² by air knife coater, dried and then subjected to super-calendering treatment to obtain a copy sheet. For comparison, a copy sheet is prepared exactly in the same manner as in Example 21 except that the acceptor dispersion is formulated without conducting mechanical activation treatment. The copy sheets are evaluated with the results given in Tables 7 and 8.

EXAMPLE 25 AND COMPARISON EXAMPLE 20

To 240 parts of 10% aqueous solution of gelatin is added 100 parts of alkylnaphthalene solution containing 2 parts of Crystal Violet lactone to obtain an emulsion containing particles 5 $\mu$ in mean particle size. To the emulsion is further added 470 parts of 5% aqueous solution of gum arabic, and the pH of the resulting system is adjusted to 4.2. The system is then cooled to 15° C. After adding 60 parts of titanium oxide to the system, the mixture is further cooled at 8° C. Subsequently, 30 parts of 10% aqueous solution of formalin is added to the mixture, and the pH of the resulting system is adjusted to 10.3. The system is left to stand for maturing, after which 110 parts of 10% aqueous solution of polyvinyl alcohol is added thereto to obtain a microcapsule-containing coating composition.

The coating composition is applied, in an amount of 5 g/m² calculated as solids, to a paper substrate weighing 40 g/m² by air knife coater and then dried. The acceptor coating composition obtained in Example 13 is further applied, in an amount of 4 g/m² based on solids, to the surface of the resulting coating by air knife coater, and dried to obtain a copy sheet of the self-contained system type. For comparison, a copy sheet of the same type is prepared exactly in the same manner as in Example 25 except that the reactant dispersion is formulated without mechanical activation treatment. The copy sheets are evaluated with the results given in Tables 7 and 8.

Table 7

| | Dispersion before pulverization | | Colour acceptor coating composition | | Colour acceptor | |
|---|---|---|---|---|---|---|
| | concentration (%) | pH | concentration (%) | pH | Mean particle size of colour acceptor ($\mu$) | Reduction[*1] of pulverized colour acceptor (%) |
| Comparison Ex. 19 | 38 | 7.0 | 22 | 7.0 | 6.9 | 0 |
| Ex. 21 | 38 | 7.0 | 32 | 7.0 | 5.8 | 15.9 |
| Ex. 22 | 38 | 8.0 | 32 | 7.9 | 5.7 | 17.4 |
| Ex. 23 | 38 | 9.1 | 32 | 9.0 | 5.6 | 18.8 |
| Ex. 24 | 38 | 10.5 | 32 | 10.3 | 5.4 | 21.7 |
| Comparison Ex. 20 | 30 | 9.1 | 20 | 9.1 | 6.6 | 0 |
| Ex. 25 | 30 | 9.1 | 30 | 9.1 | 5.5 | 16.7 |
| Comparison Ex. 21 | 39 | 7.0 | 25 | 7.0 | 7.0 | 0 |
| Ex. 26 | 39 | 7.0 | 35 | 7.0 | 5.9 | 15.7 |

Note
[*1]Reduction of mean particle size of pulverized colour acceptor.

Table 8

| | Density of the colour | | Printability | |
|---|---|---|---|---|
| | 10 seconds after | 30 minutes after | density of print | picking resistance |
| Comparison Ex. 19 | 0.43 | 0.44 | 0.91 | C |
| Ex. 21 | 0.62 | 0.70 | 1.14 | A |
| Ex. 22 | 0.63 | 0.73 | 1.14 | A |
| Ex. 23 | 0.65 | 0.76 | 1.16 | A |
| Ex. 24 | 0.66 | 0.76 | 1.16 | A |
| Comparison Ex. 20 | 0.42 | 0.43 | 0.90 | C |
| Ex. 25 | 0.64 | 0.75 | 1.15 | A |
| Comparison Ex. 21 | 0.58 | 0.74 | 0.81 | A |
| Ex. 26 | 0.65 | 0.80 | 0.85 | A |

Table 8 shows that the copy sheets obtained in Examples are excellent in colour forming ability and printability.

What is claimed is:

1. In a copy sheet for use in pressure senstive manifold sheets of a transfer-copy system comprising a support having coated thereon a layer of electron accepting reactant material including a binder, an improvement which is characterized in that said electron accepting reactant material is a calcined activated clay which is pulverized in water to a particle size at least 10% smaller, based on the mean particle size thereof, than before the pulverization and has a resulting mean particle size of 1 to 10 $\mu$.

2. The copy sheet according to claim 1, in which said particle size is at least 15% smaller based on the mean particle size.

3. The copy sheet according to claim 1, in which said mean particle size of the calcined activated clay is 2 to 8 $\mu$.

4. The copy sheet according to claim 1, in which said layer further contains microcapsules containing electron donating colourless chromogenic material.

5. Pressure sensitive manifold sheets of a transfer-copy system having the copy sheet claimed in claim 1 and a transfer sheet comprising a color-forming coating on a support.

6. Pressure sensitive manifold sheets of a transfer-copy system having the copy sheet claimed in claim 1, a transfer sheet comprising a color-forming coating on a support and at least one middle sheet, said middle sheet being positioned between the copy sheet and transfer sheet and the middle sheet having one surface coated with a color-forming coating and the other surface coated with an acceptor coating.

7. Pressure sensitive manifold sheets of transfer-copy system having the copy sheet claimed in claim 4.

8. A method for preparing a copy sheet claimed in claim 1 comprising a step of forming a coating layer on a support from a coating composition, said coating composition comprising water, a calcined activated clay as an electron accepting reactant material and binder dispersed or dissolved therein, wherein said calcined activated clay is pulverized in water to a particle size at least 10% smaller, based on the mean particle size thereof, than before the pulverization and having a resulting mean particle size of 1 to 10 $\mu$.

9. The method for preparing a copy sheet according to claim 8, in which said pulverization is conducted by sand grinder.

* * * * *